US005354188A

United States Patent [19]

Arbogast et al.

[11] Patent Number: 5,354,188

[45] Date of Patent: Oct. 11, 1994

[54] SICKLELESS INTERNAL GEAR PUMP WITH RADIALLY MOVABLE SEALING ELEMENTS FOR RADIAL COMPENSATION

[75] Inventors: Franz Arbogast; Peter Peiz, both of Heidenheim, Fed. Rep. of Germany

[73] Assignee: J. M. Voith GmbH, Heidenheim, Fed. Rep. of Germany

[21] Appl. No.: 33,296

[22] Filed: Mar. 17, 1993

[30] Foreign Application Priority Data

Mar. 19, 1992 [DE] Fed. Rep. of Germany ..... 4208767

[51] Int. Cl.[5] ..... F01C 19/08

[52] U.S. Cl. ..... 418/132; 418/171

[58] Field of Search ..... 418/169, 171, 131, 132, 418/133

[56] References Cited

U.S. PATENT DOCUMENTS 3,496,877 2/1970 Eckerle et al. ..... 418/131
3,912,427 10/1975 Eckerle et al. ..... 418/133
4,801,255 1/1989 Wankel ..... 418/168
4,969,806 11/1990 Nusser ..... 418/171

*Primary Examiner*—Richard A. Bertsch
*Assistant Examiner*—Charles G. Freay
*Attorney, Agent, or Firm*—Baker & Daniels

[57] ABSTRACT

The invention relates to a sickleless internal gear pump with an internal ring gear and a pinion meshing with the ring gear. The ring gear and pinion are rotatably mounted in a common housing part having an axial expanse corresponding to the width of the teeth of the ring gear and the pinion. The housing features a suction port and a pressure port. The ring gear features radial ports for the fluid medium to be pumped. Disposed in the pressure side region of the housing, opposite the rotating gearing parts of the ring gear and the pinion, is an axially movable axial disk exerting a force on the rotating gearing parts dependent on an axial pressure derived from the working pressure. The axially movable disk provides axial sealing by compensating for the gap between it and the fixed housing.

4 Claims, 2 Drawing Sheets

SICKLELESS INTERNAL GEAR PUMP WITH RADIALLY MOVABLE SEALING ELEMENTS FOR RADIAL COMPENSATION

BACKGROUND OF THE INVENTION

The present invention concerns a sickleless internal gear pump having an internal ring gear and a pinion, and used for generating high pressure. A pump of this categorial design is known as a particular embodiment from DE 41 04 397 A1.

Internal gear pumps generally feature an internal ring gear with which an external pinion with a fewer number of teeth is in mesh, i.e., engages the ring gear in driving fashion. Normally, the teeth of such pumps—based on the diameter of the pinion or ring gear—are relatively narrow so that—once the volume flow to be pumped has been determined by the height of the teeth and the width of the gears—this volume flow is for design reasons limited with popular pumps. Sickleless internal gear pumps specifically have the advantage of a minimal size. For improving the tightness, viewed in peripheral direction, i.e., between the tooth heads of pinion and ring gear, DE 41 04 397 A1 already proposed to insert a sealing element in each of the tooth heads of one of the two gears. These sealing elements are on the backside in contact with the pressure region so that, as the gears mesh, they bear in sealing fashion on the tooth head of always the other gear.

On the sickleless internal gear pump known from DE 41 04 397 A1, however, due to manufacturing tolerances and/or as a consequence of current working conditions, that is, with unfavorable conditions between the rotating gearing parts of the ring gear and pinion, for one, and the fixed housing part for another, a gap may occur. A result of this gap is lacking tightness of the internal gear pump, which in the final analysis means a loss of medium pumped and thus a drop of the volumetric efficiency. The more favorable gap conditions required for a remedy could be realized only at an extremely high manufacturing expense.

The problem underlying the present invention is to propose a sickleless internal gear pump of the categorial type where the sealing effect in the pressure buildup between the opposing gearing parts, for one, and the housing part for another, is improved without causing the manufacturing expense to rise overproportionally, and with the result that the aforementioned shortcomings will be eliminated.

SUMMARY OF THE INVENTION

The present invention provides adjusting and minimizing the gap between the rotating gearing parts, ring gear and pinion for one, and the fixed housing part for another, quasi automatically, not to say after the fashion of a control loop. The gap is narrowed as the working pressure increases, thus improving the tightness of the internal gear pump.

This improves also the volumetric efficiency, with the final result that the internal gear pump is suited for elevated pressures.

BRIEF DESCRIPTION OF THE DRAWINGS

The invention will be more fully explained hereafter with the aid of the drawing, which shows in FIG. 1(*a*and *b*), a cross section and a partial longitudinal section of a sickleless internal gear pump in the area of the two gears.

DETAILED DESCRIPTION OF THE INVENTION

Figure 1B:
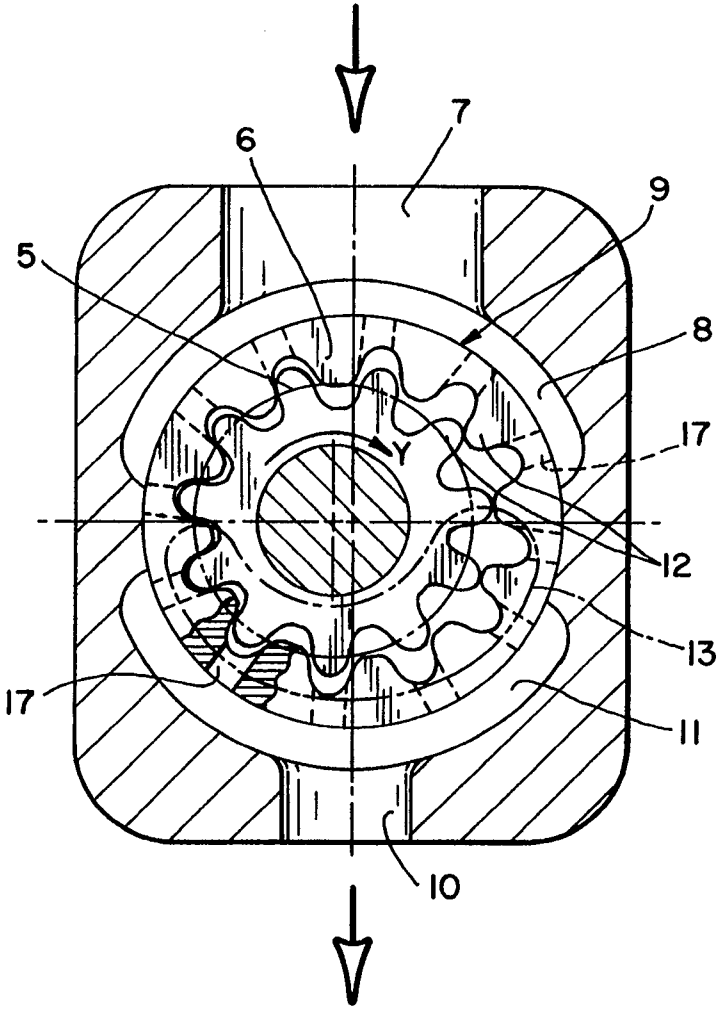
Figure 1A:
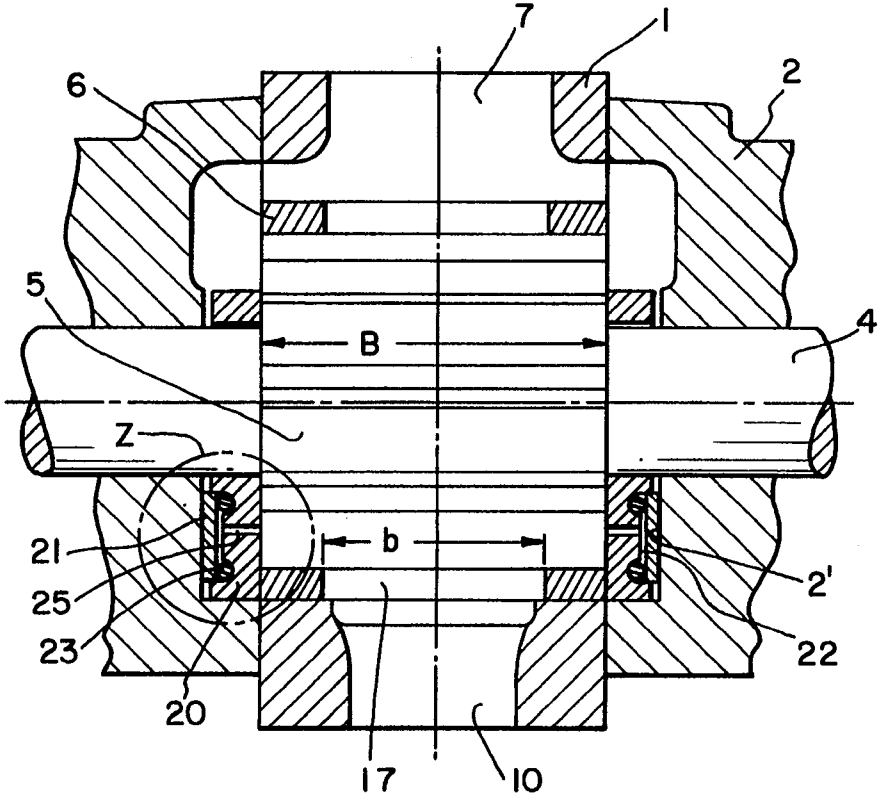

In cross section, FIG. 1 shows a sickleless internal, head-sealing gear pump which is subject to backlash and seals always with one flank, and at that, in the area of a housing center part 1 followed—viewed in axial direction—by a housing part 2. The entire pump with the two housing parts has an axial overall length L. An external pinion 5 fastened on a drive shaft 4 is in mesh with an internal ring gear 6. The teeth 12 of the pinion 5 and ring gear 6 have an axial width B, the pinion a pitch circle diameter d0; the width of the gears is greater than the pitch circle diameter d0. The pinion 5 and the ring gear 6 are not coaxial but installed eccentrically to one another; furthermore, the pinion 5 has one tooth less than the ring gear 6, so that the outside of a tooth head on the pinion 5 always makes contact with the inside of a tooth head on the ring gear 6. Visible, furthermore, is a suction port 7 in the zone where the teeth on the pinion 5, or ring gear 6, disengage while rotating in the direction of arrow Y. The suction port 7 in the housing center part 1, in which the ring gear 6 and pinion 5 are installed, is in axial direction followed, toward the adjacent housing parts, by a suction pocket 8 extending across part of the shell surface 9 of the ring gear 6. Originating as well from a pressure pocket 11 extending across a peripheral area on the ring gear, a pressure port 10 is located on the opposite side of the pump. The inflow of pressure medium to the interior of the pump, i.e., to the tooth spaces in the pinion 5 and ring gear 6 effecting the pumping of the pressure medium, takes place via radial ports 17 in the ring gear 6. These ports 17 originate from the shell surface 9 and empty in the tooth bottom of the ring gear 6.

The sickleless internal gear pump described so far pertains to the prior art.

As illustrated in FIG. 1, there is now arranged, in the pressure side region of the outer housing part 2, and at that, in the region opposite the rotating gearing parts of ring gear 6 and pinion 5, an axially—more exactly axially parallel to the axis of the drive shaft 4—adjustable, or movable, axial disk 20, and at that—according to the pictorial illustration—on both sides of the pinion 5, or ring gear 6. But it is quite conceivable to provide the axial compensation to be explained hereafter on only one side, i.e., a single compensation.

The design and function of the axial disk 20 are as follows: In its basic shape, the axial disk 20 is a circular disk with an eccentric bore through which, in the assembled state of the pump, extends the drive shaft 4. The resulting eccentric disk is with its wider segment situated in a matching recess 2' of the housing part 2, and at that, in the pressure side region. Toward the bottom of this recess 2' the axial disk 20 is opposed by an axial piston 21 which plunges into a complementary annular space 22 of the axial disk 20 and is sealed relative to that space by a pair of O-rings 23. Created between the bottom of the annular space 22 of the axial disk 20 and the plunging piston 21 is a free space (pressure space) 24 which—with a pressure medium admitted—spreads The axial disk 20 and the axial piston 21 diametrically apart. The axial piston 21 is thus forced on the wall of the recess 2' and the axial disk 20 on the gearing parts of the pinion 5 and ring gear 6, thereby closing any gap.

Basically it is conceivable to couple the pressure in the free space between the axial disk 20 and the axial piston 21 to an external pressure generator which, depending on the working pressure of the internal gear pump, generates a contact pressure for the axial disk 20. In the illustrated embodiment, a simple design solution has been chosen which provides for machining in the axial disk 20 a connecting bore 25 which connects the pressure side 10 of the internal gear pump with the said free space 24. The latter is thus automatically and in direct contingence on the working pressure acted upon by the pressure medium, forcing the axial disk 20 on the gearing parts of the internal gear pump. This type of axial compensation, so to speak, may be considered and described as an AUTOMATIC seal.

Special attention should be devoted to the selection of the material for the axial disk 20. Experience has shown that aluminum, nonferrous metal, plated steel or fiber-reinforced, particularly carbon fiber-reinforced, plastic have proved to be particularly suited materials.

Figure 2:
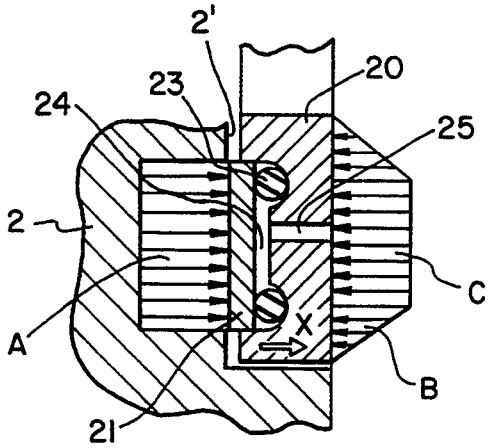
FIG. 2 , a first embodiment of an axial seal in detail illustration (detail "Z" in FIG. 1) showing the pressure fields.

The operating mode of the axial compensation illustrated with the aid of FIG. 1 is once more illustrated in detail with the aid of FIG. 2 which, scaled up, shows the detail "Z" according to FIG. 1.

Illustrated in the recess 2' of the housing part 2 is the axial compensation comprised of the axial disk 20 and the axial piston 21, and at that, including the pressure fields which are effective on them. The axial disk 20 is fitted in the recess 2' in axially movable fashion (compare arrow X) and bears through the intermediary of O-rings 23 and the axial piston 21 on the housing wall. As pressure medium, coming from the internal gear pump via the connecting bore 25, enters the free, or pressure, space 24 between the axial disk 20 and the axial piston 21, the axial disk 20 is forced away from the axial piston 21 and closes the gap. The axial piston 21 is opposed by an external pressure field "A" matching its expanse, while the axial disk 20 is opposed by an inner pressure field which is composed of a rim pressure field "B" originating from the two rim regions and growing linearly and a central main pressure field "C". The outer pressure field is greater than the inner one, so that the axial disk 20 is forced on the gearing parts.

Figure 3:
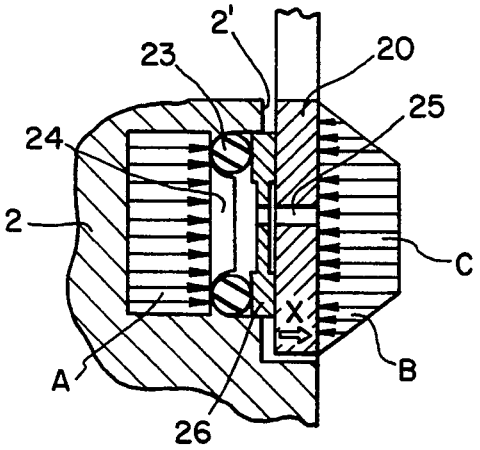
FIG. 3, a second embodiment of an axial seal with illustration of the pressure fields.

FIG. 3 illustrates a second embodiment of an axial compensation with the pertaining pressure fields. In variation from the embodiment according to FIG. 2, the outer pressure field "A" is machined here in the housing 2, and at that, in a way such that a sealing disk 26 bears on the inside of the axial disk 20, that the connecting bore extends through the axial disk 20 and the sealing disk 26, and that the free, or pressure space 24 is created between the sealing disk 26 and the recess 2' in the housing 2. The pressure space again is sideways sealed by O-ring 23, and the unit comprised of the axial disk 20 and the sealing disk 26 is forced away (refer to arrow X) from the housing 2 axially parallel to the drive shaft 4.

The outer pressure field "A"—analogous to FIG. 2—again is opposed by the inner pressure field composed of the rim pressure fields "B" and the main pressure field "C."

Figure 4:
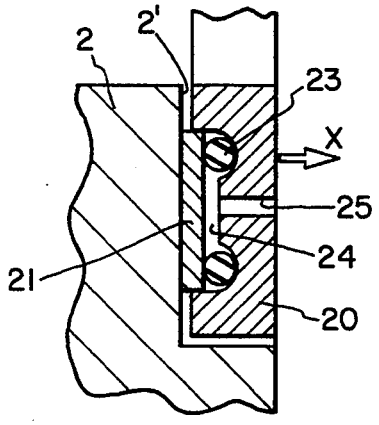
FIG. 4, a separate illustration of the first embodiment of the seal.
Figure 5:
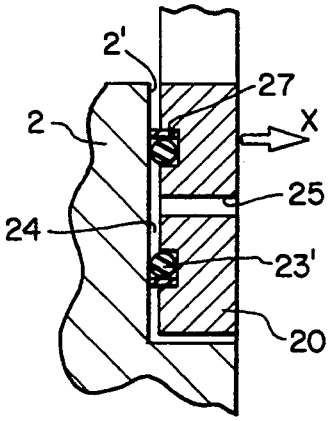
FIG. 5, a separate illustration of a second embodiment of a seal.
Figure 6:
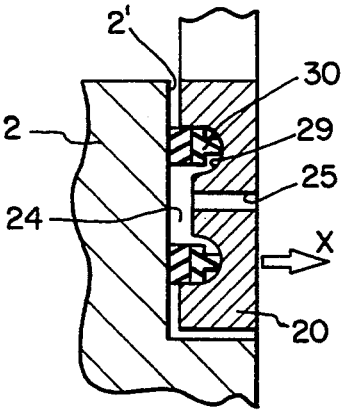
FIG. 6 , a separate illustration of a third embodiment of a seal.

FIGS. 4, 5 and 6 show alternative embodiments for designing the rim seals of the free, or pressure space 24 between the axial disk 20 and the housing 2.

The embodiment shown in FIG. 4 corresponds to the design illustrated with the aid of FIG. 1 and 2. The axial disk 20 opposes the housing 2 jointly with the axial piston 21; the two form a pressure space 24 which is acted upon by pressure medium from the pressure side of the internal gear pump. The pressure space is sealed sideways by O-rings 23 so that, as the pressure increases in the pressure space 24, the axial disk 20 is forced (in the direction X) away from the housing 2 and seals the gap between the gearing parts and the housing 2.

In the embodiment shown in FIG. 5, the axial disk 20 opposes the housing 2 through the intermediary of a pair of so-called back rings 27. These are fitted in rectangular grooves 28 in the axial disk 20, with an O-ring 23' additionally inserted in these grooves 28 for sealing the pressure space 24. The back rings 27 are situated along the shell line of the axial pressure field 13 (refer to FIG. 1) and serve to prevent the O-ring 23' from creeping under pressure into the gap. As pressure medium is admitted to the pressure space 24 via the connecting bore 25, the back rings 27 bear on the housing 2, forcing the axial disk 20 (in the direction X) away from the housing 2.

FIG. 6 shows a third embodiment of the design for sealing the pressure space 24. The axial disk 20 features here a surrounding round groove 29 (refer to FIG. 1) which defines the axial pressure field 13 and in which a shaped seal 30 is fitted. These shaped seals 30 bear with their second sides on the wall of the recess 2' in the housing 2 and—viewed axially feature materials of differentiated hardness, creating a composite material structure. As pressure medium is allowed to act upon the pressure space 24 defined by the shaped seals 30, the axial disk 20 is forced (in the direction X) away from the housing 2, and the shaped seals 30 simultaneously seal the pressure space 24 relative to the housing through the specific material structure, with the seal not entering the gap.

We claim:

1. A sickleless internal gear pump, comprising:

an internal ring gear having a plurality of teeth and radial ports;

a pinion having a plurality of teeth and meshing with said ring gear;

a housing rotatably carrying said ring gear and said pinion, said housing including a suction port and a pressure port, said housing having an axial expanse corresponding to the width of said ring gear teeth and said pinion teeth, said housing defining a pressure region;

an axially movable disk disposed in said pressure region at an axial end of said ring gear and pinion between said housing and said ring gear and pinion, said axially movable disk exerting an axial force against said ring gear and said pinion which is dependent upon fluid pressure within said pressure region, said axially movable disk sealing between said housing and said ring gear and pinion; and a sealing disk disposed between said housing and said axially movable disk, and a seal disposed between said housing and said sealing disk, said housing, sealing disk and seal defining a pressure space therebetween, said axially movable disk and said sealing disk including a connecting bore for fluidly connecting said pressure space with said pressure region.

2. The sickleless internal gear pump of claim 1, wherein said seal is an O-ring.

3. A sickleless internal gear pump, comprising:

an internal ring gear having a plurality of teeth and radial ports;

a pinion having a plurality of teeth and meshing with said ring gear;

a housing rotatably carrying said ring gear and said pinion, said housing including a suction port and a pressure port, said housing having an axial expanse corresponding to the width of said ring gear teeth and said pinion teeth, said housing defining a pressure region;

an axially movable disk disposed in said pressure region at an axial end of said ring gear and pinion between said housing and said ring gear and pinion, said axially movable disk exerting an axial force against said ring gear and said pinion which is dependent upon fluid pressure within said pressure region, said axially movable disk sealing between said housing and said ring gear and pinion; and an O-ring and a back ring disposed between said axially movable disk and said housing, said housing, axially movable disk, O-ring and back ring defining a pressure space therebetween, said axially movable disk including a connecting bore for fluidly connecting said pressure space with said pressure region.

4. A sickleless internal gear pump, comprising:

an internal ring gear having a plurality of teeth and radial ports;

a pinion having a plurality of teeth and meshing with said ring gear;

a housing rotatably carrying said ring gear and said pinion, said housing including a suction port and a pressure port, said housing having an axial expanse corresponding to the width of said ring gear teeth and said pinion teeth, said housing defining a pressure region;

an axially movable disk disposed in said pressure region at an axial end of said ring gear and pinion between said housing and said ring gear and pinion, said axially movable disk exerting an axial force against said ring gear and said pinion which is dependent upon fluid pressure within said pressure region, said axially movable disk sealing between said housing and said ring gear and pinion; and a shaped seal disposed between said axially movable disk and said housing, said shaped seal having a composite material structure, said housing, axially movable disk and shaped seal defining a pressure space therebetween, said axially movable disk including a connecting bore for fluidly connecting said pressure space with said pressure region.

* * * * *